US011932434B2

(12) United States Patent
Fortini et al.

(10) Patent No.: US 11,932,434 B2
(45) Date of Patent: Mar. 19, 2024

(54) PACKING METHOD AND UNIT TO PACK ARTICLES, IN PARTICULAR STRAWS, WITH AUTOMATIC REJECTION OF DEFECTIVE ARTICLES

(71) Applicant: G.D SOCIETA' PER AZIONI, Bologna (IT)

(72) Inventors: Massimo Fortini, Bologna (IT); Fabrizio Fazzioli, Bologna (IT); Gaetano Balboni, Bologna (IT); Giuliano Gamberini, Bologna (IT)

(73) Assignee: G.D SOCIETA' PER AZIONI, Bologna (IT)

( * ) Notice: Subject to any disclaimer, the term of this patent is extended or adjusted under 35 U.S.C. 154(b) by 0 days.

(21) Appl. No.: 17/698,947

(22) Filed: Mar. 18, 2022

(65) Prior Publication Data

US 2022/0306327 A1 Sep. 29, 2022

(30) Foreign Application Priority Data

Mar. 19, 2021 (IT) ..... 102021000006605

(51) Int. Cl.
*B65B 35/26* (2006.01)
*B65B 11/10* (2006.01)
(Continued)

(52) U.S. Cl.
CPC ..... *B65B 35/26* (2013.01); *B65B 11/10* (2013.01); *B65B 19/34* (2013.01); *B65B 57/10* (2013.01)

(58) Field of Classification Search
None
See application file for complete search history.

(56) References Cited

U.S. PATENT DOCUMENTS 4,384,441 A * 5/1983 Maruyama ..... B65B 9/04 53/553
6,000,199 A * 12/1999 Boldrini ..... B65B 11/30 53/466

(Continued)

FOREIGN PATENT DOCUMENTS

EP 2799349 A1 11/2014
EP 3613293 A1 2/2020

(Continued)

OTHER PUBLICATIONS

Italian Search Report for corresponding Italian Application No. 102021000006605 dated Nov. 30, 2021.

(Continued)

*Primary Examiner* — Tanzim Imam
(74) *Attorney, Agent, or Firm* — MARSHALL, GERSTEIN & BORUN LLP

(57) ABSTRACT

A packing method and unit to pack articles, includes: moving first seats by a first conveyor and second seats by a second conveyor along first and second paths at first and second moving speeds, respectively; and cyclically transferring an article from a first seat to a second seat in a transfer station. The first seats and second seats each designed to house an article. During normal operation with no rejected articles, the first moving speed is functionally equal to the second moving speed, and the same number of first and second seats pass through the transfer station in a given time interval. Where at least one article is rejected in a first seat, the second moving speed is functionally decreased relative to the first moving speed so that two first seats (one containing the rejected article) passes through the transfer station in the time interval as one second seat.

21 Claims, 6 Drawing Sheets

(51) Int. Cl.
*B65B 19/34* (2006.01)
*B65B 57/10* (2006.01)

(56) References Cited

U.S. PATENT DOCUMENTS

| | | | | |
|---|---|---|---|---|
| 10,766,650 | B2 | 9/2020 | Choplin et al. | |
| 10,869,488 | B2 | 12/2020 | Singer et al. | |
| 2020/0060295 | A1 * | 2/2020 | Singer | B65G 47/841 |

FOREIGN PATENT DOCUMENTS

| | | | | |
|---|---|---|---|---|
| KR | 960006145 | Y1 * | 7/1996 | B65B 19/34 |
| KR | 200160426 | Y1 * | 11/1999 | B65B 19/34 |

OTHER PUBLICATIONS

European Search Report for Corresponding European Application No. 22163091.6, dated Aug. 2, 2022.

* cited by examiner

PACKING METHOD AND UNIT TO PACK ARTICLES, IN PARTICULAR STRAWS, WITH AUTOMATIC REJECTION OF DEFECTIVE ARTICLES

CROSS-REFERENCE TO RELATED APPLICATIONS

This Patent Application claims priority from Italian Patent Application No. 102021000006605 filed on Mar. 19, 2021, the entire disclosure of which is incorporated herein by reference.

BACKGROUND

Technical Field

The present invention relates to a packing method and to a unit to pack articles, in particular straws.

The present invention finds advantageous application to the packaging of straws, to which the following disclosure will make explicit reference without thereby losing generality.

Prior Art

Straws are known which provide a corrugated intermediate portion aimed at allowing the straw to be bent in order to assume, in use, the most adapted shape to satisfy the user.

For some applications, a straw is individually packed (namely, it is inserted singularly in its own wrapping) after being bent in a "U" shape (namely, by 180°) in the area of the corrugated intermediate portion (the purpose of the "U" bending is to reduce the overall dimension of the straw); typically, it is required to individually pack the straws bent in a "U" shape when the straws have to be fixed (glued) to the back wall of a beverage container.

A known packaging machine for individually packing straws comprises: a hopper containing a mass of straws, a withdrawal drum that picks up the straws from the hopper, a bending drum that bends each straw, and a wrapping drum that has a plurality of suction seats each designed to house a portion of a first continuous (namely, seamless) band of wrapping material and a straw. Each suction seat of the wrapping drum receives a portion of the first continuous band of wrapping material which is arranged bent in a "U" shape inside the suction seat to define a pocket and then receives a straw (which is placed inside the pocket) directly from the bending drum. The wrapping drum is coupled to an applicator drum which applies (typically by heat sealing), to the first continuous band of wrapping material, a second continuous band of wrapping material which closes the pockets containing the straws. Then, a continuous (namely, seamless) succession of pockets each containing a straw is fed, at the output of the wrapping drum; this continuous succession of pockets, each containing a straw, is referred to as a "cartridge belt" in jargon.

Currently, if a straw is defective, it is necessary to eliminate the defective straw from the "cartridge belt" by cutting the "cartridge belt" upstream and downstream of the defective straw and then performing a "restoration" of the continuity of the "cartridge belt" (namely, by making a junction between the two recently cut ends of the "cartridge belt"). In the same way, currently if a pocket is empty because a problem in the packaging machine occurred (for example, a failed withdrawal of a straw from the hopper or the accidental loss thereof) it is necessary to remove the empty pocket from the "cartridge belt" by cutting the "cartridge belt" upstream and downstream of the empty pocket and then performing a "restoration" of the continuity of the "cartridge belt" (namely, by making a junction between the two recently cut ends of the "cartridge belt"). However, these operations must be carried out manually and therefore engage an average skilled operator for a considerable amount of time, normally forcing the packaging machine to stop or to considerably slow down.

SUMMARY

The object of the present invention is to provide a packing method and a unit to pack articles, in particular straws, which are more efficient, avoiding a manual intervention of an operator in case of a defective article or of a missing article.

According to the present invention, a packing method and a unit to pack articles, in particular straws, are provided, according to what is established in the attached claims.

The claims describe preferred embodiments of the present invention forming an integral part of the present description.

BRIEF DESCRIPTION OF THE DRAWINGS

The present invention will now be described with reference to the attached drawings, which illustrate some non-limiting embodiments thereof, wherein.

DETAILED DESCRIPTION

Figure 1:
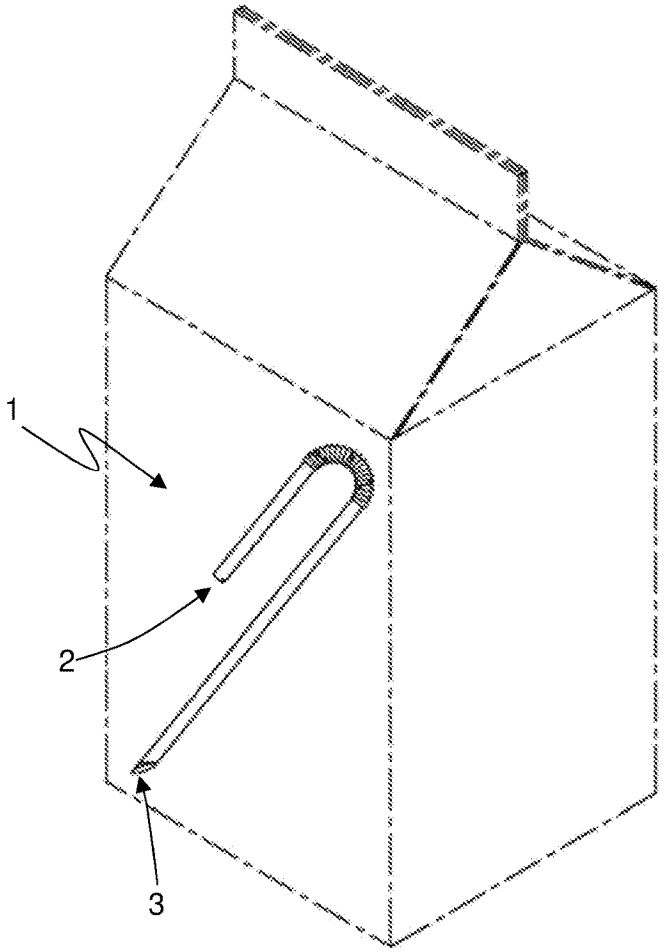
FIG. 1 is a perspective view of a straw applied to a beverage package.

In FIG. 1, number 1 denotes as a whole a straw (made of paper or plastic material) which is applied to the back of a beverage package. The straw 1 has a flat end 2 (which is grasped by the user's lips) and a pointed end 3 (to more effectively break through the cap that seals a dispensing opening of the package).

Furthermore, the straw 1 has a corrugated intermediate portion 4 in the area of which the straw 1 can be bent easily and without breaking (namely, in an elastic manner) so as to assume, in use, the most adapted shape in order to satisfy the user.

Figure 2:
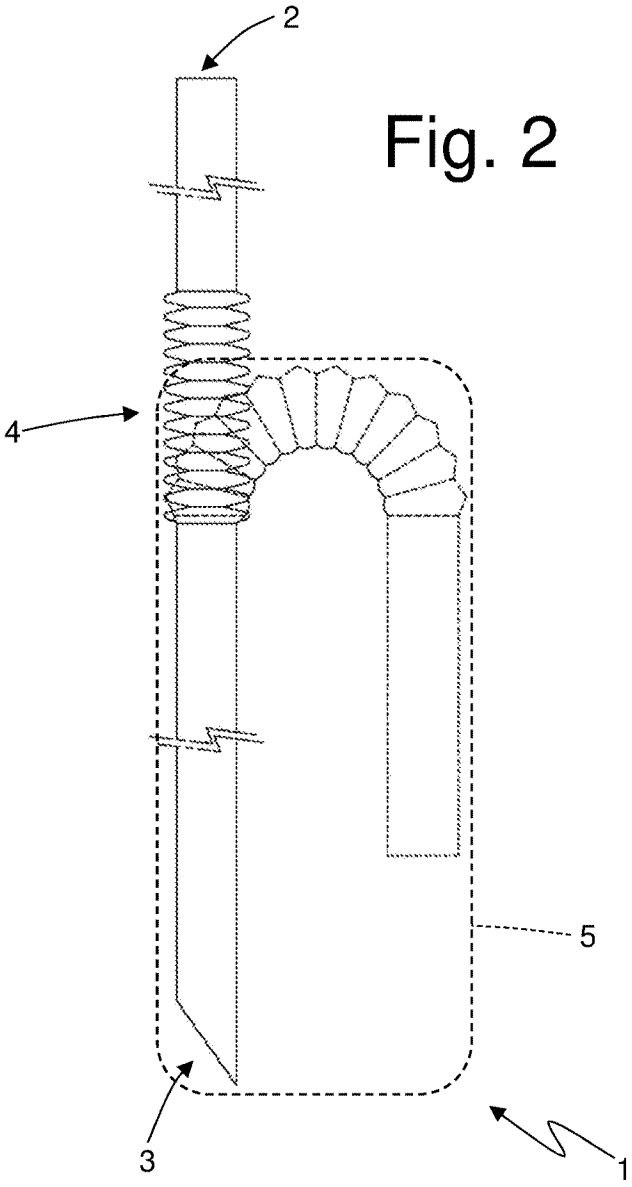
FIG. 2 is a view on an enlarged scale of the straw of FIG. 1.

The straw 1 is individually packed (namely, it has been inserted singularly in its own wrap 5 not illustrated in FIG. 1 and illustrated in FIG. 2) after being bent in a "U" shape (namely, by 180°) in the area of the corrugated intermediate portion 4 (the purpose of the "U" bending is to reduce the overall dimension of the straw 1 so as to remain within the overall dimensions of the back wall of the package to which the straw 1 is applied).

Figure 3:
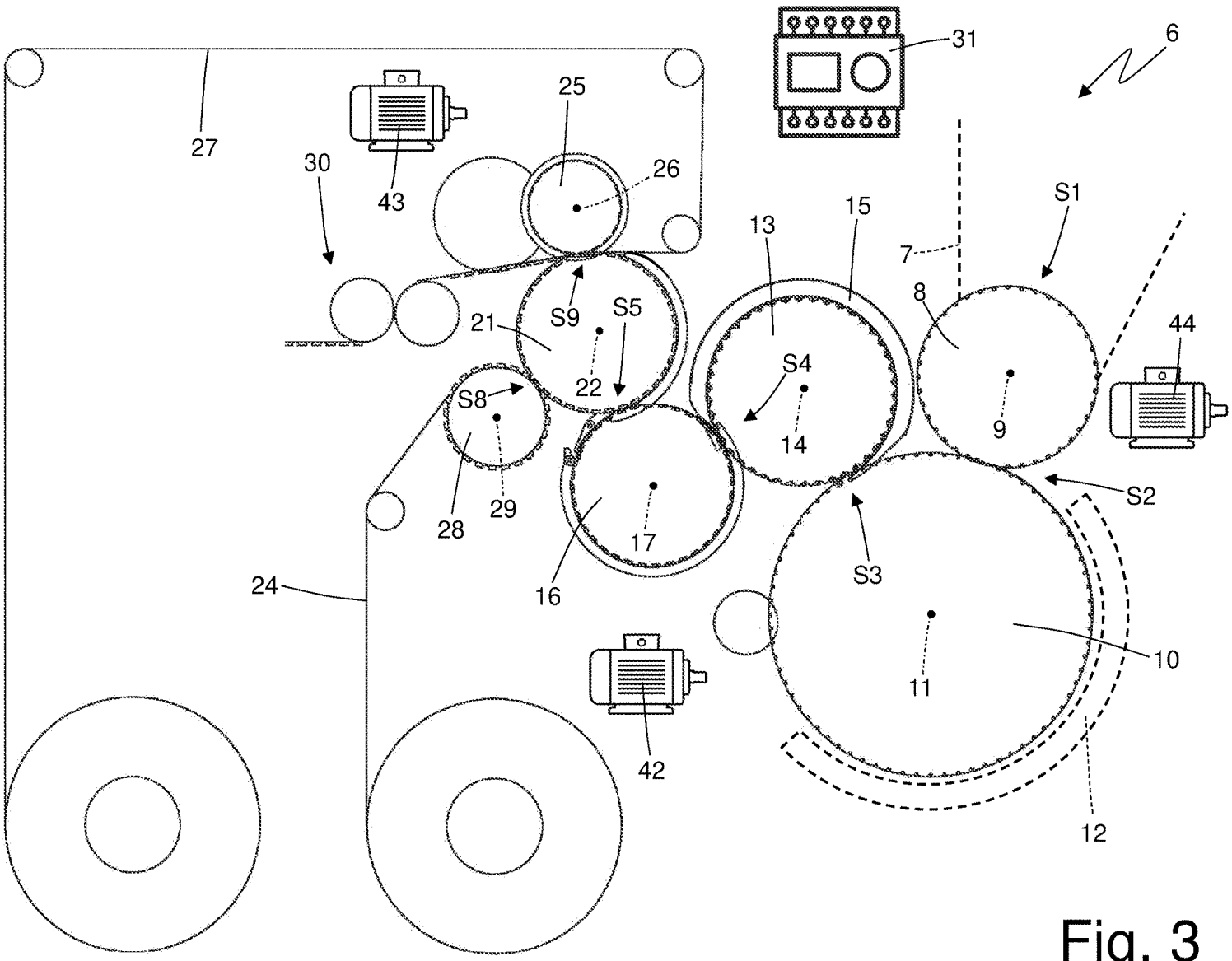
FIG. 3 is a schematic and front view of a packaging machine which bends and wraps the straw of FIG. 1.

In FIG. 3, number 6 denotes as a whole a packaging machine which receives the straws 1 from a packing machine (not illustrated), corrugates the straws 1, bends the straws 1 in a "U" shape, and inserts the straws 1 in corresponding wraps 5.

The packaging machine 6 comprises a hopper 7 which is designed to contain a mass of straws 1 coming from the packing machine and which move progressively downwards by gravity, namely, towards the bottom of the hopper 7. As an alternative to the hopper 7, the packaging machine 6 could provide any buffer or collector of a mass of straws. As a further alternative, the packaging machine 6 could receive the straws in an orderly manner (that is, not collected in a mass), for example directly from the packing machine.

A pick-up conveyor 8 is arranged on the bottom of the hopper 7, which, in an input station 51 picks up a succession of straws 1 moving them crosswise (namely, perpendicularly to a longitudinal axis of the straws 1). According to a preferred embodiment illustrated in the attached figures, the pick-up conveyor 8 is formed by a drum which is mounted rotatable around a rotation axis 9 (horizontal and perpendicular to the plane of FIG. 3) and has a plurality of suction seats each designed to house a corresponding straw 1. According to a different embodiment not illustrated, the pick-up conveyor 8 is a conveyor belt, namely, it comprises a flexible belt which is closed in a loop around two end pulleys and supports a plurality of suction seats each designed to house a corresponding straw 1.

The packaging machine 6 comprises a corrugator drum 10, which is mounted rotatable around a rotation axis 11 (parallel to the rotation axis 9), has a plurality of seats each designed to house a corresponding straw 1, and receives the straws 1 directly from the pick-up conveyor 8 in a transfer station S2. A corrugator device 12 is arranged along the periphery of the corrugator drum 10, which corrugates the straws 1, namely, forms the corrugated intermediate portion 4 in each straw 1.

According to an embodiment not illustrated, the packaging machine 6 could receive already corrugated straws 1; in this case, the packaging machine 6 does not comprise the corrugator drum 10.

The packaging machine 6 comprises a bending drum 13, which is mounted rotatable around a rotation axis 14 (parallel to the rotation axis 11), has a plurality of suction seats each designed to house a corresponding straw 1, and receives the straws 1 directly from the corrugator drum 10 in a transfer station S3. Bending elements 15 are arranged around the rotation axis 14 in a fixed position (namely, integral with a frame of the packaging machine 6 and therefore devoid of movement) which are coupled to the bending drum 13 and interact with the straws 1 carried by the suction seats to bend the straws 1 in a "U" shape.

According to an embodiment not illustrated, the packaging machine 6 does not perform the "U" bending of the straws 1; in this case, the packaging machine 6 does not comprise the bending drum 13.

The packaging machine 6 comprises a reject drum 16, which is mounted rotatable around a rotation axis 17 (parallel to the rotation axis 14), has a plurality of seats 18 (better illustrated in FIGS. 4-7) each designed to house a corresponding straw 1 bent in a "U" shape, receives the straws 1 directly from the bending drum 13 in a transfer station S4, and releases the straws 1 in a transfer station S5 arranged downstream of the transfer station S4 relative to the rotation direction of reject drum 16.

Figure 4:
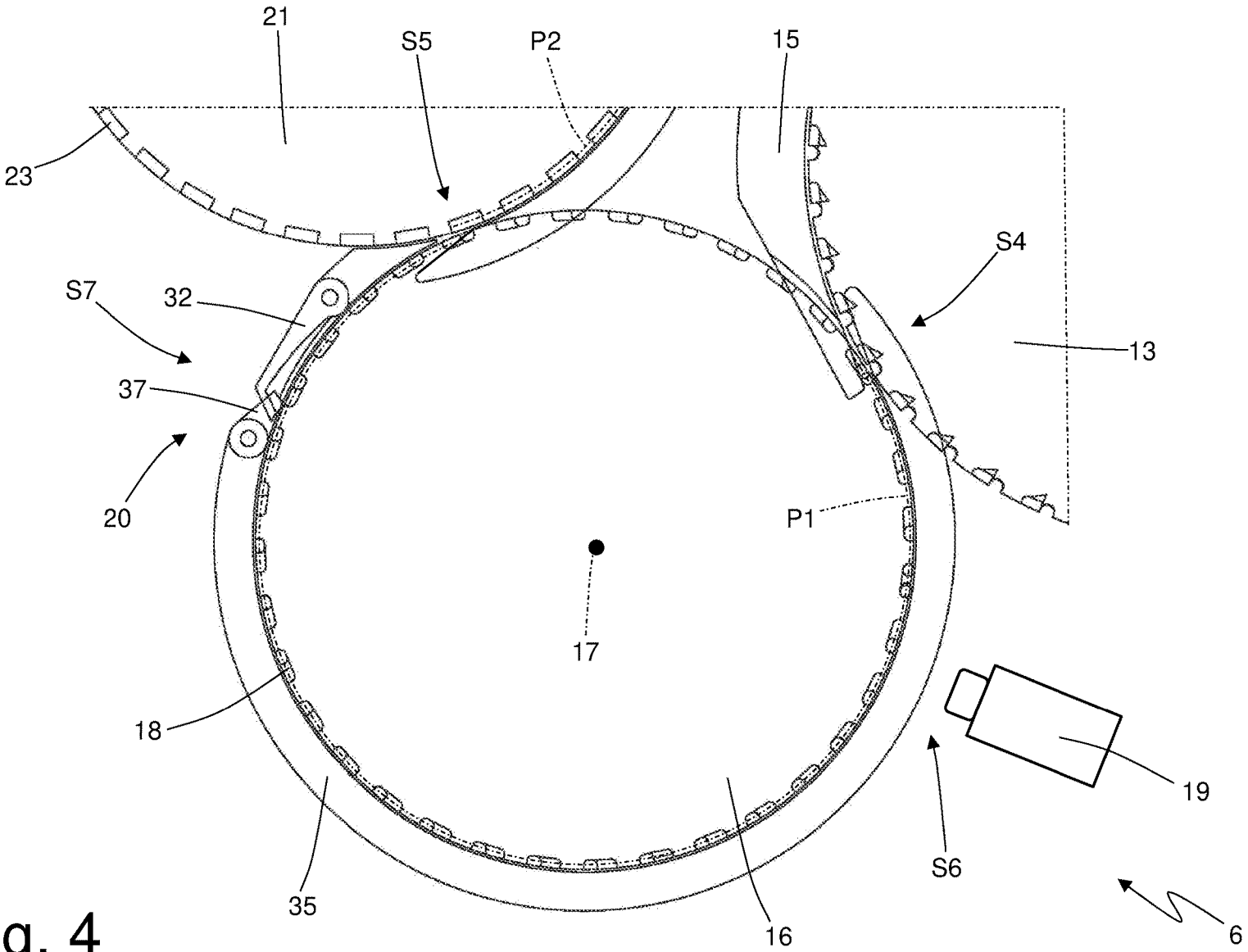
FIG. 4 is a view on an enlarged scale of a reject drum of the packaging machine of FIG. 3.

As illustrated in FIG. 4, a control station S6 is arranged between the transfer station S4 and the transfer station S5 and along the periphery of the reject drum 16, which is provided with a control device 19 that is configured to perform a quality control of each straw 1 that is moved from a seat 18 through the control station S6 in order to determine whether the straw 1 complies with the required quality standards and therefore is acceptable or whether the straw 1 does not complies to the required quality standards and therefore it must be rejected. According to a preferred embodiment, the control device 19 comprises at least one video camera which frames a portion of the shell of the reject drum 16 in the area of the control station S6 and performs an optical control of the straws 1 (namely, acquires and analyses at least one digital image of each straw 1).

A reject station S7 is provided between the control station S6 and the transfer station S5 and along the periphery of the reject drum 16, which is provided with a reject device 20 that is designed to extract a straw 1 from the corresponding seat 18 and therefore direct the extracted straw 1 towards a recovery area (for example, provided with a removable reject container to be periodically emptied).

As illustrated in FIG. 3, the packaging machine 6 comprises a wrapping drum 21, which is mounted rotatable around a rotation axis 22 (parallel to the rotation axis 17), has a plurality of suction seats 23 (better illustrated in the FIGS. 4-7) each designed to house a portion of a continuous (namely, seamless) band 24 of wrapping material and a straw 1 bent in a "U" shape. Each suction seat 23 of the wrapping drum 22 receives, in a feeding station S8, a portion of the continuous band 24 of wrapping material which is arranged bent in a "U" shape inside the suction seat 23 to define a pocket and then receives a straw 1 (that is arranged inside the pocket previously formed in the suction seat 23) directly from the reject drum 16 in the transfer station S5. An applicator drum 25 is coupled to the wrapping drum 21, which is mounted rotatable around a rotation axis 26 (parallel to the rotation axis 22) and applies (typically by heat sealing) a continuous band 27 of wrapping material, which closes the pockets containing the straws 1, to the continuous band 24 of wrapping material, and in a feeding station S9. Then, a continuous (namely, seamless) succession of pockets, each containing a straw 1, is fed at the output of the wrapping drum 21; this continuous succession of pockets, each containing a straw 1, is referred to as a "cartridge belt" in jargon.

In particular, an inserter drum 28 is provided, which is mounted rotatable around a rotation axis 29 (parallel to the rotation axis 22) and has a plurality of projections, each designed to insert a portion of the continuous band 24 of wrapping material into each seat 23 of the wrapping drum 21, which is arranged, bent in a U-shape, inside the same suction seat 23 thus forming a corresponding pocket.

The packaging machine 6 comprises an output conveyor 30 which receives the "cartridge belt" (namely, it receives a continuous band 5 of wrapping material containing respective straws 1) from the wrapping drum 21 and moves the "cartridge belt" towards an output of the packaging machine 6.

The packaging machine 6 comprises a control unit 31 which supervises the operation of all the components of the packaging machine 6.

Preferably, the whole packaging machine 6 operates with a law of continuous motion, namely, with movements at a normally constant speed (when the productivity of the packaging machine 6 is stable or in a steady state and therefore not transitory).

Figure 5:
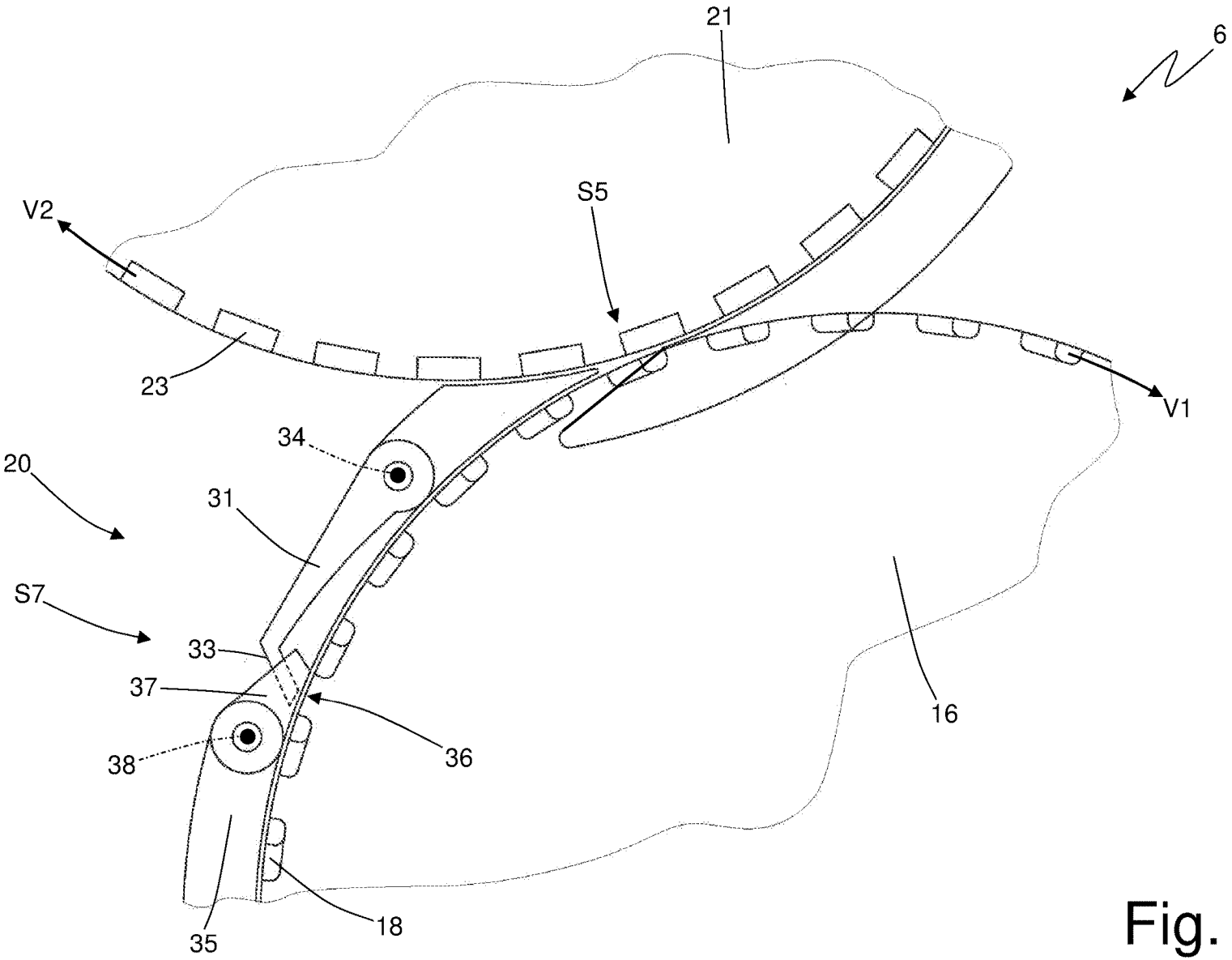
FIGS. 5 and 6 are two views of part of the reject drum of FIG. 4 in two different operation moments.
Figure 6:
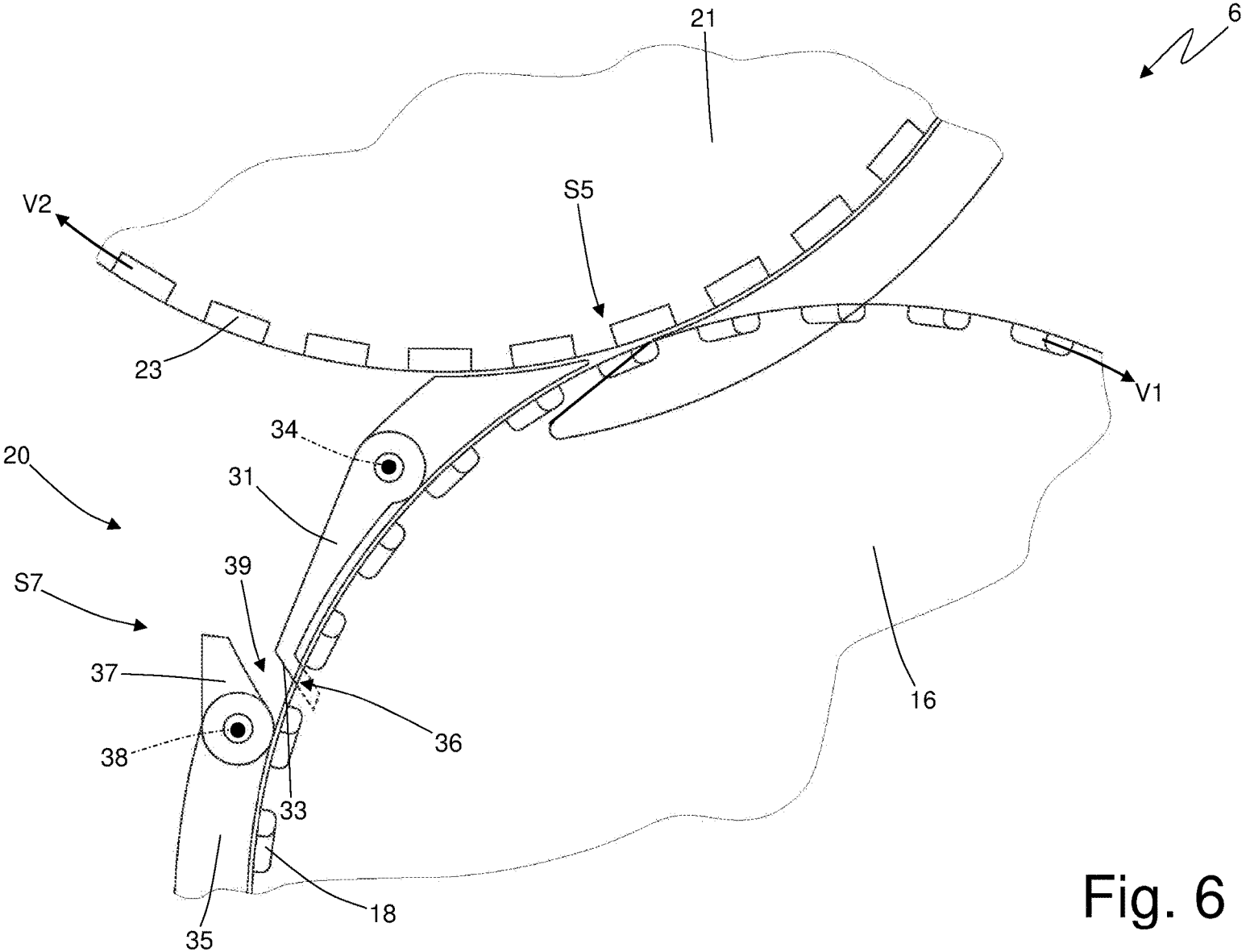
Figure 7:
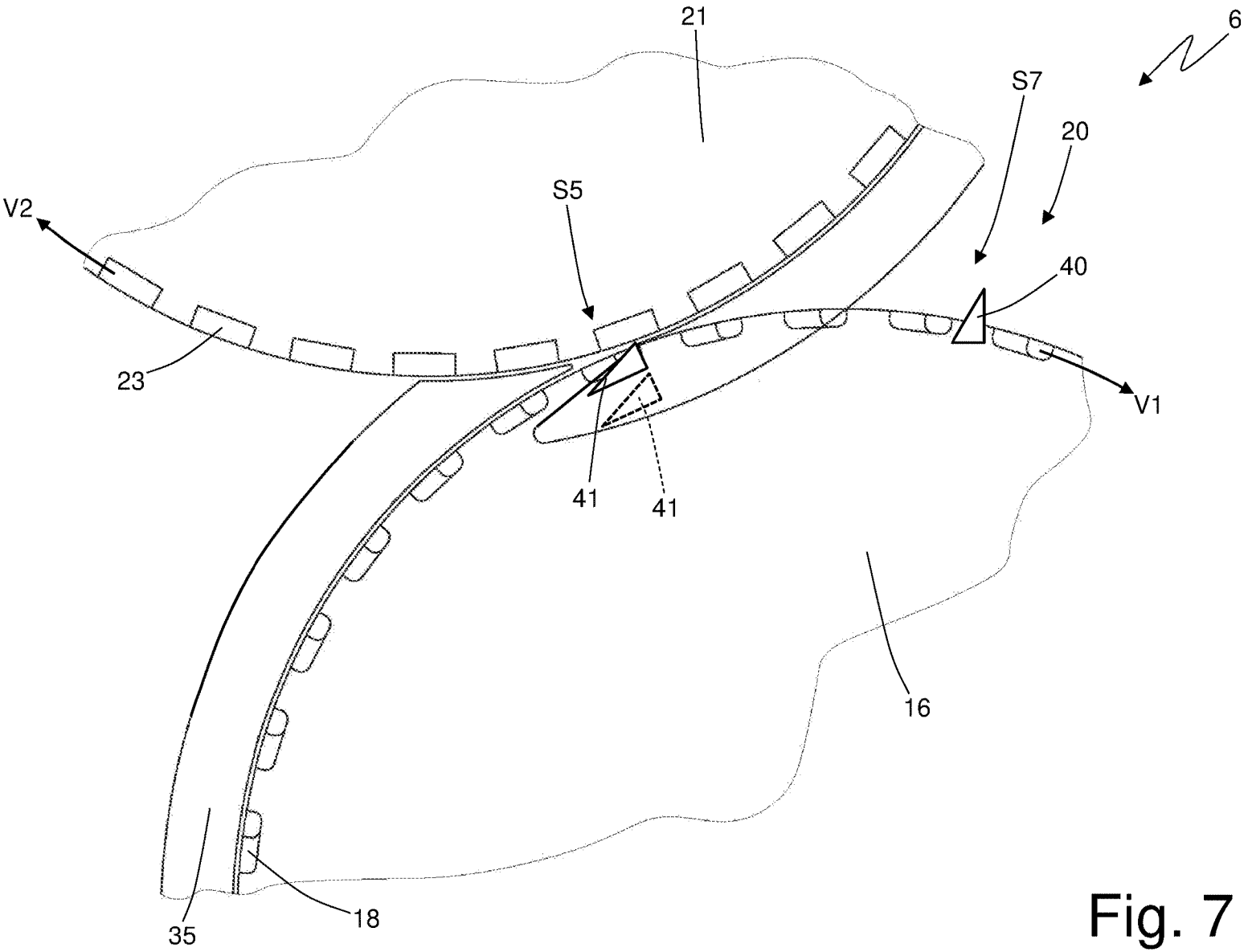
FIG. 7 is a view of part of the reject drum of FIG. 4 according to an alternative embodiment.

In use and according to what is better illustrated in FIG. 4, the reject drum 16 moves the seats 18 (each designed to house a straw 1), along a path P1 (that extends from the transfer station S4 to the transfer station S5 and also passes through the control station S6 and the reject station S7) and with a moving speed V1 (schematically illustrated in FIGS. 5, 6 and 7); furthermore, the wrapping drum 21 moves the seats 23 (each designed to house a straw 1), along a path P2 (that extends from the transfer station S5) and with a moving speed V2 (schematically illustrated in FIGS. 5, 6 and 7).

Normally, each seat 18 of the reject drum 16 arriving in the transfer station S5 should contain a corresponding transferable straw 1, namely, a straw 1 that can (must) be transferred to a respective seat 23 of the wrapping drum 21 to enter a pocket formed by a portion of a continuous band 24. However, it could happen that (in a completely undesirable but not completely eliminable way) a seat 18 of the reject drum 16 arriving in the transfer station S5 does not contain a transferable straw 1 because the seat 18 is empty (namely, it does not contain any straw 1 at all) or because the seat 18 contains a defective straw 1 (therefore to be rejected and not to be inserted into a seat 23 of the wrapping drum 21 to enter a pocket formed by a portion of a continuous band 24).

In use, a seat 18 of the reject drum 16 is identified as not containing a transferable straw 1 because it is empty from the beginning of the path P1 or because the straw 1 contained in the seat 18 is identified as defective and therefore to be rejected. In other words, the control unit 31 optically inspects each seat 18 of the reject drum 16 along the path P1 and in the control station S6 arranged upstream of the transfer station S5 in order to establish whether the seat 18 contains a straw 1 (namely, whether the seat 18 is empty or full) and whether the straw 1 contained in the seat 18 (obviously only if the seat 18 is full) is defective.

Obviously, a seat 18 is empty from the beginning of the path P1 due to an undesired and accidental problem (inconvenience, error) that occurred upstream of the path P1 such as, for example, failure to pick up a straw 1 by a suction seat of the pick-up conveyor 8 or loss of a straw 1 from a suction seat of the corrugator drum 10 or from a suction seat of the bending drum 13.

In case of normal operation during which all the seats 18 contain transferable straws 1 (namely, all the seats 18 are full of respective straws 1 that are not to be rejected), the control unit 31 always maintains the moving speed V1 functionally equal to the moving speed V2 so that, within a same time frame, the same number of seats 18 and 23 pass through the transfer station S5; namely, each seat 18 of the reject drum 16 is "matched up" with one and only one corresponding seat 23 of the wrapping drum 21 so that all the straws 1 that move through the reject drum 16 are transferred to the wrapping drum 21, filling all the seats 23 of the wrapping drum 21. It is important to note that the control unit 31 does not keep the two moving speeds V1 and V2 equal in absolute terms but keeps them the same in functional terms (namely, by ensuring that the same number of seats 18 and 23 always pass through the exchange station S5 so that each seat 18 can transfer its own straw 1 to a corresponding seat 23 without leaving empty seats 23 downstream of the transfer station S5).

The absolute value of the moving speeds V1 and V2 depends on the diameter of the drums 16 and 21 and on the number of seats 18 and 23 present in the drums 16 and 21 and the moving speeds V1 and V2 would be not only functionally but also in absolute value the same if the drums 16 and 21 were equal to one another (that is, having the same diameter and having the same number of seats 18 and 23).

On the other hand, in case of at least one seat 18 of the reject drum 16 not containing a transferable straw 1 (because the straw 1 is absent from the beginning or because the straw 1 is to be rejected), the control unit 31 functionally decreases the moving speed V2 relative to the moving speed V1, so that, within a same exchange time interval, in which one single seat 23 of the wrapping drum 21 passes through the transfer station S5, (at least) two seats 18 of the reject drum 16 (one of which does not contain a transferable straw 1) pass through the transfer station S5; moreover, in these conditions, the control unit 31 makes it possible to transfer, in the transfer station S5 and during the exchange time interval, only the transferable straw 1 (namely, the straw 1 that is different from, other than, any straw 1 to be rejected) from a corresponding seat 18 to a corresponding seat 23. Preferably, in case of at least one seat 18 of the reject drum 16 not containing a transferable straw 1, the moving speed V2 is decreased to zero, namely, until temporarily stopping the wrapping drum 21.

Normally, there is only one seat 18 of the reject drum 16 not containing a transferable straw 1 and therefore the control unit 31 functionally decreases the moving speed V2 relative to the moving speed V1, so that, within a same exchange time interval, in which a single seat 23 of the wrapping drum 21 passes through the transfer station S5, (exactly) two seats 18 of the reject drum 16 (one of which does not contain a transferable straw 1) pass through the transfer station S5; however, it may happen that there is a series of seats 18 of the reject drum 16 not containing a transferable straw 1 and therefore the control unit 31 functionally decreases the moving speed V2 relative to the moving speed V1, so that, within a same exchange time interval, in which a single seat 23 of the wrapping drum 21 passes through the transfer station S5, a series (three, four, five . . . ) of seats 18 of the reject drum 16 (all except one of them not containing a transferable straw 1) pass through the transfer station S5.

Therefore, the reject drum 16 has the effect of interrupting the continuity of the flow of straws 1 avoiding the propagation of voids or straws 1 to be rejected from the section of the machine upstream of the reject drum 16 to the section of the machine downstream of the reject drum 16. In other words, the reject drum 16 decouples the flow of straws 1 upstream of the reject drum 16 from the flow of straws 1 downstream of the reject drum 16, avoiding the propagation of voids or straws 1 to be rejected and thus ensuring the formation of a complete "cartridge belt" (that is, without voids).

In combination with the operations described above, the control unit 31 extracts (if present) any straw 1 to be rejected from the corresponding seat 18 in the reject station S7 (that is arranged upstream of the transfer station S5) so that the seat 18 which initially contained the straw 1 to be rejected arrives empty (and therefore without a transferable straw 1) in the transfer station S5. The "hole" created by the absence of the rejected straw 1 in the corresponding seat 18 is "filled" due to the fact that during the exchange time interval (at least) two seats 18 of the reject drum 16 pass (one of which empty, previously containing the straw 1 to be rejected and therefore without a transferable straw 1) through the transfer station S5 and a single seat 23 of the wrapping drum 21; therefore the only seat 23 of the wrapping drum 21 receives a straw 1 and no seat 23 of the wrapping drum 21 remains empty.

As illustrated in FIGS. 5 and 6, the reject station S7 is provided with a deflector element 32 which is movable between an inactive position (illustrated in FIG. 5) in which the deflector element 32 does not interfere with the forward movement of the straws 1 housed in the seats 18 of the reject drum 16 and an active position (illustrated in FIG. 6) in which the deflector element 32 intercepts a straw 1 housed in a seat 18 which moves together with the reject drum 16 by pushing the straw 1 (radially) out of the seat 18. The control unit 31 normally holds (namely, when there are no straws 1 to be rejected) the deflector element 32 in the inactive position (illustrated in FIG. 5); when a straw 1 must be rejected, the control unit 31 moves the deflector element 32 from the inactive position (illustrated in FIG. 5) to the active position (illustrated in FIG. 6) immediately upstream of the passage of the seat 18 containing the straw 1 to be rejected and returns the deflector element 32 from the active position (illustrated in FIG. 6) to the inactive position (illustrated in FIG. 5) immediately after the passage of the seat 18 containing the straw 1 to be rejected.

According to the preferred embodiment illustrated in the attached figures, the deflector element 32 has, at the front, an inclined plane 33, which, in the active position (illustrated in FIG. 6) is oriented crosswise to the path P1 and intercepts the path P1 so that the movement imparted to the straw 1 to be rejected along the path P1 by the conveyor 18 causes the straw 1 to be rejected slide along the inclined plane 33 progressively moving the straw 1 to be rejected away from the path P1 and, hence, from the corresponding seat 18. Furthermore, according to the preferred embodiment illustrated in the attached figures, the deflector element 32 is hinged around a rotation axis 34 (parallel to the rotation axis 17) and rotates to move between the inactive position (illustrated in FIG. 5) and the active position (illustrated in FIG. 6).

According to the preferred embodiment illustrated in the attached figures, a side wall 35 is coupled to the reject drum 16 which prevents a straw 1 from getting out of the corresponding seat 18, extends from the transfer station S4 to the transfer station S5 and has a reject opening 36 in the area of the reject station S7; furthermore, a gate 37 is provided, which is movable between a closed position (illustrated in FIG. 5) in which the gate 37 closes the reject opening 36 and an open position (illustrated in FIG. 6) in which the gate 37 leaves the reject opening 36 free. The control unit 31 moves the gate 37 between the closed position (illustrated in FIG. 5) and the open position (illustrated in FIG. 6) simultaneously (namely, in a synchronized manner) with the movement between the inactive position (illustrated in FIG. 5) and the active position (illustrated in FIG. 6) of the deflector element 32. In particular, when the gate 37 is in the open position (illustrated in FIG. 6) it defines, together with the deflector element 32 which is in the active position (illustrated in FIG. 6) an output channel 39 through which the straw 1 to be rejected moves away from the corresponding seat 18 of the reject drum 16. Furthermore, according to the preferred embodiment illustrated in the attached figures, the gate 37 is hinged around a rotation axis 38 (parallel to the rotation axis 17 and to the rotation axis 34) and rotates to move between the closed position (illustrated in FIG. 5) and the open position (illustrated in FIG. 6).

The nominal speed of the packaging machine 6 is of the order of thousands of straws 6 processed per minute (operating on a single line, namely, of the order of two thousand straws 6 processed per minute operating on a double line) and consequently, the nominal rotation speed of the reject drum 16 (assuming it is provided with thirty-six seats 18) is approximately 0.5 revolutions/second. At these nominal rotational speed values, the deflector element 32 may not have sufficient time to move between the inactive position and the active position and vice versa in the time interval that passes between the passage of a seat 18 and of the immediately subsequent seat 18 (since there are structural and functional limits to the accelerations to which the deflector element 32 can be subjected during its movements) through the rejection station S7. To overcome this problem, the control unit 31 can decrease the moving speed V1 of the reject drum 16 down to a predetermined reject value (typically a fraction of the nominal value, for example 5-15% of the nominal value), when the seat 18 containing the straw 1 to be rejected is approaching the reject station S7 so that the seat 18 containing the straw 1 to be rejected passes through the reject station S7 with the moving speed V1 equal to the predetermined reject value. Clearly, the control unit 31 maintains the moving speed V2 of the wrapping drum 21 always functionally equal to the moving speed V1 of the reject drum 16 (excluding the only exception represented by the passage of the seat 18 not containing a transferable straw 1 through the transfer station S5).

According to a preferred embodiment, the control unit 31 maintains the moving speed V1 of the reject drum 16 equal to the reject value until the seat 18 containing the straw 1 to be rejected has also passed through the transfer station S5 (namely, not just the reject station S7); in this way also the variation (decrease) of the moving speed V2 of the wrapping drum 21 to the passage of the seat 18 not containing a transferable straw 1 passes through the transfer station S5 occurs when the moving speed V2 of the wrapping drum 21 is (significantly) lower than a nominal value and in this way the decelerations/accelerations to which the wrapping drum 21 is subjected are significantly reduced.

In general, regardless of the movement limits of the deflector element 32, the control unit 31 reduces the moving speed V2 of the wrapping drum 21 (and therefore also the moving speed V1 of the reject drum 16) to a value (significantly) lower than a nominal value (for example, 5-15% of the nominal value) when the seat 18 not containing a transferable straw 1 passes through the transfer station S5 so as to significantly reduce the decelerations/accelerations to which the wrapping drum 21 is subjected.

The side wall 35, the periphery of the reject drum 16, the deflector element 21 and the gate 37 are made in a "comb-like" manner so as to be able to mutually interpenetrate without mechanical interference.

In the embodiment illustrated in FIGS. 3-6, the reject station S7 is arranged upstream of the transfer station S5 relative to the rotation direction of the reject drum 16 and therefore the seat 18 not containing a transferable straw 1 (namely, which initially contained the straw 1 to be rejected) arrives empty in the transfer station S5. According to a different embodiment illustrated in FIG. 7, the reject station S7 is arranged downstream of the transfer station S5 relative to the rotation direction of the reject drum 16 and therefore the seat 18 not containing a transferable straw 1 (namely, still containing the straw 1 to be rejected) arrives (still) full in the transfer station S5 and passes through (namely, still containing the straw 1 to be rejected) the transfer station S5 full. Namely, the straw 1 to be rejected is extracted from the corresponding seat 18 in the reject station S7 arranged downstream of the transfer station S5 so that the seat 18 not containing a transferable straw 1 (namely, containing the straw 1 to be rejected) passes through the transfer station S5 full.

In the embodiment illustrated in FIG. 7, the reject station S7 is provided with a deflector element 40, which is permanently arranged in an active position in which the deflector element 40 intercepts a straw 1 housed in a seat 18 that moves together with the reject drum 16 by pushing the straw 1 out of its seat 18.

In the embodiment illustrated in FIG. 7, the transfer station S5 comprises a pushing element 41, which is movable between an active position (illustrated with a solid line in FIG. 7) in which the pushing element 41 imparts a thrust to a straw 1 passing through the transfer station S5, which transfers the straw 1 from the corresponding seat 18 to the corresponding seat 23, and an inactive position (illustrated with dashed line in FIG. 7) in which the pushing element 41 does not interact with a straw 1 passing through the transfer station S5. The control unit 31 normally maintains (namely, when there are no straws 1 to be rejected) the pushing element 41 in the active position; when a straw 1 is to be rejected, the control unit 31 moves the pushing element 41 from the active position (illustrated with a solid line in FIG. 7) to the inactive position (illustrated with dashed line in FIG. 7) immediately upstream of the passage of the seat 18 not containing a transferable straw 1 (namely, containing the straw 1 to be rejected) and brings the deflector element 32 from the inactive position (illustrated with a dashed line in FIG. 7) to the active position (illustrated with a solid line in FIG. 7) immediately after the passage of the seat 18 not containing a transferable straw 1 (namely, containing the straw 1 to be rejected).

With reference to the embodiment of the reject drum 16 illustrated in FIG. 7, the packaging machine may differ from that illustrated in FIG. 3 in that the bending drum 13 coincides with the reject drum 16. In this case, the machine 1 could comprise: a pick-up conveyor 8 which, in an input station 51, picks up a succession of straws 1 moving them crosswise; a corrugator drum 10, which is mounted rotatable around a rotation axis 11 (parallel to the rotation axis 9), has a plurality of seats each designed to house a corresponding straw 1, and receives the straws 1 directly from the pick-up conveyor 8 in a transfer station S2; a bending (and reject) drum 13, which is mounted rotatable around a rotation axis 14 (parallel to the rotation axis 11), has a plurality of suction seats each designed to house a corresponding straw 1, and receives the straws 1 directly from the corrugator drum 10 in a transfer station S3.

As previously stated, the moving speed V1 of the reject drum 16 must be (temporarily) varied relative to the moving speed V2 of the wrapping drum 21 when a seat 18 of the reject drum 16 containing a straw 1 to be rejected passes through the transfer station S5. Consequently, and as illustrated in FIG. 3, the reject drum 16 must be rotated by an electric motor 42 (that preferably also rotates the corrugator drum 10 and the bending drum 13), which must be mechanically independent from an electric motor 43 that rotates the wrapping drum 21 (and preferably also rotates the applicator drum 25, the inserter drum 28 and the output conveyor 30). According to a preferred embodiment, a further electric motor 44 is provided, which is mechanically independent from the electric motors 42 and 43 and rotates the pick-up conveyor 8. The three electric motors 42, 43 and 44 have no mechanical constraint between them and are kept synchronized one with the other only by means of the control logic implemented in the control unit 31.

According to a preferred embodiment, the packaging machine 6 operates on a double line, namely, it processes two straws 1 arranged side by side (that is, axially aligned with one another) at a time. In other words, the pick-up conveyor 8 has a series of pairs of suction seats (axially aligned with one another) to pick up two straws 1 at a time from the output mouth of the hopper 7, the corrugator drum 10 has a series of pairs of seats (axially aligned with one another), which simultaneously receive two straws 1 from the pick-up conveyor 8, simultaneously corrugate two straws 1 together with the corrugator device 12, and simultaneously release two straws 1 to the bending drum 13. In turn, the bending drum 13 has a series of pairs of suction seats (axially aligned with one another) which simultaneously receive two straws 1 from the corrugator drum 10, simultaneously bend two straws 1, and simultaneously release two straws 1 to the reject drum 16. In turn, the reject drum 16 has a series of pairs of seats 18 (axially aligned with one another) which simultaneously receive two straws 1 from the bending drum 13 and simultaneously release two straws 1 to the wrapping drum 21. In turn, the wrapping drum 21 has a series of pairs of suction seats 23 (axially aligned with one another), which simultaneously receive two straws 1 from the reject drum 16, simultaneously form two wraps 5 (operating with two continuous bands 24 and 27 of wrapping material of double width), and simultaneously release two wraps 5 to the output conveyor 30. In turn, the output conveyor 30 has a series of pairs of suction seats (axially aligned with one another) which simultaneously receive two wraps 5 from the wrapping drum 21.

According to a different embodiment, the packaging machine 6 operates on a single line, namely, it processes only one straw 1 at a time.

According to a further embodiment, the packaging machine 6 operates on a triple or quadruple line, namely, processes three or four straws 1 arranged side by side (that is, axially aligned with one another) at a time.

The embodiments described herein can be combined with one another without departing from the scope of the present invention.

The packaging machine 6 described above has numerous advantages.

Firstly, the packaging machine 6 described above allows to operate at a high efficiency avoiding manual intervention of an operator in case of a defective straw 1 that must be rejected (namely, extracted from the production flow) or in case of a seat 18 of the reject drum 16 that is empty from the beginning.

Furthermore, the packaging machine 6 described above is simple, inexpensive and compact to implement.

The invention claimed is:

1. A packing method to pack articles (1), comprising the steps of:

moving, by means of a first rotary conveyor (16), first seats (18), each designed to house an article (1), along a first path (P1) and with a first moving speed (V1);

moving, by means of a second rotary conveyor (21), second seats (23), each designed to house an article (1), along a second path (P2) and with a second moving speed (V2);

feeding, in a first feeding station (S8) arranged along the second path (P2), in each second seat (23) a portion of a first continuous band (24) of wrapping material which is arranged in the second seat (23) so as to define a pocket;

cyclically transferring an article (1) from a first seat (18) to a second seat (23) in a transfer station (S5), where the first path (P1) and the second path (P2) face one another and which is arranged downstream of the first feeding station (S8) in order to insert the article (1) in a corresponding pocket of the first continuous band (24) of wrapping material provided in the second seat (23); and applying, in a second feeding station (S9) arranged along the second path (P2) downstream of the transfer station (S5), to the first continuous band (24) of wrapping material, a second continuous band (27) of wrapping material that closes the pockets containing the articles (1) which are arranged in the second seats (23);

wherein, in case of normal operation during which all the first seats (18) contain transferable articles (1), the first moving speed (V1) is functionally equal to the second moving speed (V2), so that, within a same time frame, the same number of first and second seats (18, 23) move through the transfer station (S5);

wherein the packing method comprises, in case of at least one first seat (18) not containing a transferable article (1), the further steps of:

functionally decreasing the second moving speed (V2) relative to the first moving speed (V1) so that, within a same exchange time interval, in which one single second seat (23) passes through the transfer station (S5), at least two first seats (18), one of which does not contain a transferable article (1) and one of which contains a single transferable article (1), pass through the transfer station (S5); and transferring, in the transfer station (S5) and during the exchange time interval, the single transferable article (1) from the first seat which contains the single transferable article (18) to a corresponding second seat (23); and wherein the packing method comprises the further steps of: temporarily reducing, when a first seat (18) not containing a transferable article (1) is identified, both the first moving speed (V1) and the second moving speed (V2) from respective normal values to respective reject values before functionally decreasing the second moving speed (V2) relative to the first moving speed (V1); and restoring, once the first seat (18) not containing a transferable article (1) has passed the transfer station (S5), both the first moving speed (V1) and the second moving speed (V2) from their respective reject values to their respective normal values.

2. The packing method according to claim 1, wherein a first seat (18) is identified as not containing a transferable article (1) because it is empty from a beginning of the first path (P1) or because the article (1) contained in the first seat (18) is identified as defective and is therefore to be rejected.

3. The packing method according to claim 2 and comprising the further step of optically inspecting each first seat (18) along the first path (P1) and in a control station (S6) arranged upstream of the transfer station (S5) in order to establish whether the first seat (18) contains an article (1) and whether the article (1) contained in the first seat (18) is defective.

4. The packing method according to claim 1, wherein the second moving speed (V2) is functionally decreased relative to the first moving speed (V1) while keeping the first moving speed (V1) constant by reducing the second moving speed (V2) to zero to temporarily stop the second conveyor (21).

5. The packing method according to claim 1, wherein the articles (1) are fed to the first seats (18) of the first conveyor from a third conveyor (13), along which each article (1) is bent in a "U" shape.

6. The packing method according to claim 1 and comprising the further steps of:

identifying a first seat (18) as not containing a transferable article (1) because the article (1) contained in the first seat (18) is identified as defective and is therefore to be rejected; and extracting the article (1) to be rejected from the first seat (18) in a reject station (S7) arranged upstream of the transfer station (S5) so that the first seat (18), that initially contained the article (1) to be rejected, arrives empty at the transfer station (S5).

7. The packing method according to claim 6, wherein:

the reject station (S7) is provided with a deflector element (32) which is movable, between an inactive position, in which the deflector element (32) does not interfere with the forward movement of the articles (1) housed in the first seats (18), and an active position, in which the deflector element (32) intercepts an article (1) housed in a first seat (18) that moves together with the first conveyor (16), pushing the article (1) out of the first seat (18);

the deflector element (32) is normally kept in the inactive position; and the deflector element (32) is moved from the inactive position to the active position immediately before passage of the first seat (18) containing the article (1) to be rejected and is moved back from the active position to the inactive position immediately after the passage of the first seat (18) containing the article (1) to be rejected.

8. The packing method according to claim 7, wherein the first moving speed (V1) is reduced to a reject value when the first seat (18) containing the article (1) to be rejected is approaching the reject station (S7), so that the first seat (18) containing the article (1) to be rejected passes through the reject station (S7) with the first moving speed (V1) equal to the reject value.

9. The packing method according to claim 8, wherein the first moving speed (V1) is kept at the reject value until the first seat (18) containing the article (1) to be rejected has also passed through the transfer station (S5).

10. The packing method according to claim 7, wherein the deflector element (32) has, at its front, an inclined plane (33), which, in the active position is oriented crosswise to the first path (P1) and intercepts the first path (P1) so that movement imparted to the article (1) to be rejected along the first path (P1) by the first conveyor (18) causes the article (1) to be rejected to slide along the inclined plane (33), thus progressively moving the article (1) to be rejected away from the first path (P1) and, hence, away from the first seat (18).

11. The packing method according to claim 7, wherein:

the first conveyor (16) is coupled to a side wall (35) which prevents an article (1) from getting out of the first seat (18) and has a reject opening (36) in an area of the reject station (S7);

a gate (37) is provided, the gate being movable between a closed position, in which the gate (37) closes the reject opening (36), and an open position, in which the gate (37) leaves the reject opening (36) free; and the gate (37) moves between the closed position and the open position simultaneously with the movement of the deflector element (32) between the inactive position and the active position.

12. The packing method according to claim 11, wherein the gate (37), when in the open position, defines, together with the deflector element (32) in the active position, an output channel (39) through which the article (1) to be rejected moves away from the first seat (18).

13. The packing method according to claim 7, wherein the deflector element (32) hinges between the inactive position and the active position.

14. The packing method according to claim 1 and comprising the further steps of:

identifying a first seat (18) as not containing a transferable article (1) because the article (1) contained in the first seat (18) is identified as defective and is therefore to be rejected; and extracting the article (1) to be rejected from the first seat (18) in a reject station (S7) arranged downstream of the transfer station (S5), so that the first seat (18) that initially contained the article (1) to be rejected is full when it passes through the transfer station (S5).

15. The packing method according to claim 14, wherein the reject station (S7) is provided with a deflector element (41) which is permanently arranged in an active position in which the deflector element (41) intercepts an article (1) housed in a first seat (18) which moves together with the first conveyor (16) and pushes the article (1) out of the first seat (18).

16. The packing method according to claim 14, wherein:

the transfer station (S5) comprises a pushing element (42), which is movable between an active position, in which the pushing element (42) imparts a thrust to an article (1) moving through the transfer station (S5) in order to transfer the article (1) from the first seat (18) to the corresponding second seat (23), and an inactive position, in which the pushing element (42) does not interact with an article (1) moving through the transfer station (S5); and the pushing element (42) is normally kept in the active position; and the pushing element (42) is moved from the active position to the inactive position immediately before passage of the first seat (18) containing the article (1) to be rejected and is moved back from the inactive position to the active position immediately after the passage of the first seat (18) containing the article (1) to be rejected.

17. The packing method according to claim 1, wherein the articles are straws.

18. A packing method to pack articles (1), comprising the steps of:

moving, by means of a first rotary conveyor (16), first seats (18), each designed to house an article (1), along a first path (P1) and with a first moving speed (V1);

moving, by means of a second rotary conveyor (21), second seats (23), each designed to house an article (1), along a second path (P2) and with a second moving speed (V2);

feeding, in a first feeding station (S8) arranged along the second path (P2), in each second seat (23) a portion of a first continuous band (24) of wrapping material which is arranged in the second seat (23) so as to define a pocket;

cyclically transferring an article (1) from a first seat (18) to a second seat (23) in a transfer station (S5), where the first path (P1) and the second path (P2) face one another and which is arranged downstream of the first feeding station (S8) in order to insert the article (1) in a corresponding pocket of the first continuous band (24) of wrapping material provided in the second seat (23); and applying, in a second feeding station (S9) arranged along the second path (P2) downstream of the transfer station (S5), to the first continuous band (24) of wrapping material, a second continuous band (27) of wrapping material that closes the pockets containing the articles (1) which are arranged in the second seats (23);

wherein, in case of normal operation during which all the first seats (18) contain transferable articles (1), the first moving speed (V1) is functionally equal to the second moving speed (V2), so that, within a same time frame, the same number of first and second seats (18, 23) move through the transfer station (S5);

wherein the packing method comprises, in case of at least one first seat (18) not containing a transferable article (1), the further steps of: functionally decreasing the second moving speed (V2) relative to the first moving speed (V1) so that, within a same exchange time interval, in which one single second seat (23) passes through the transfer station (S5), at least two first seats (18), one of which does not contain a transferable article (1) and one of which contains a single transferable article (1), pass through the transfer station (S5); and transferring, in the transfer station (S5) and during the exchange time interval, the single transferable article (1) from the first seat (18) which contains the single transferable article (1) to a corresponding second seat (23);

wherein the packing method comprises the further steps of: identifying a first seat (18) as not containing a transferable article (1) because the article (1) contained in the first seat (18) is identified as defective and is therefore to be rejected; and extracting the article (1) to be rejected from the first seat (18) in a reject station (S7) arranged upstream of the transfer station (S5) so that the first seat (18), that initially contained the article (1) to be rejected, arrives empty at the transfer station (S5);

wherein the reject station (S7) is provided with a deflector element (32) which is movable, between an inactive position, in which the deflector element (32) does not interfere with forward movement of the articles (1) housed in the first seats (18), and an active position, in which the deflector element (32) intercepts an article (1) housed in a first seat (18) that moves together with the first conveyor (16), pushing the article (1) out of the first seat (18);

wherein the deflector element (32) is normally kept in the inactive position; and wherein the deflector element (32) is moved from the inactive position to the active position immediately before passage of the first seat (18) containing the article (1) to be rejected and is moved back from the active position to the inactive position immediately after the passage of the first seat (18) containing the article (1) to be rejected.

19. The packing method according to claim 18, wherein the first moving speed (V1) is reduced to a reject value when the first seat (18) containing the article (1) to be rejected is approaching the reject station (S7), so that the first seat (18) containing the article (1) to be rejected passes through the reject station (S7) with the first moving speed (V1) equal to the reject value.

20. The packing method according to claim 19, wherein the first moving speed (V1) is kept at the reject value until the first seat (18) containing the article (1) to be rejected has also passed through the transfer station (S5).

21. The packing method according to claim 18, wherein the deflector element (32) has, at its front, an inclined plane (33), which, in the active position is oriented crosswise to the first path (P1) and intercepts the first path (P1) so that movement imparted to the article (1) to be rejected along the first path (P1) by the first conveyor (18) causes the article (1) to be rejected to slide along the inclined plane (33), thus progressively moving the article (1) to be rejected away from the first path (P1) and, hence, away from the first seat (18).

* * * * *